US007664456B2

(12) United States Patent
Jalics et al.

(10) Patent No.: US 7,664,456 B2
(45) Date of Patent: Feb. 16, 2010

(54) SYSTEM AND METHOD FOR STREAMING DATA BETWEEN A PORTABLE SERVER COMPUTING DEVICE AND A CLIENT COMPUTING DEVICE

(75) Inventors: Laci J. Jalics, Ray, MI (US); Francis E. Szczublewski, Macomb, MI (US); Andrzej M. Pawlak, Rochester Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 477 days.

(21) Appl. No.: 11/733,382

(22) Filed: Apr. 10, 2007

(65) Prior Publication Data

US 2008/0253581 A1 Oct. 16, 2008

(51) Int. Cl.
*H04H 20/71* (2008.01)

(52) U.S. Cl. ..... 455/3.05; 455/3.01; 455/3.06; 455/41.2; 455/41.3; 455/500; 455/502; 455/556.1; 455/556.2; 455/557; 455/414.1; 455/414.3; 455/414.4; 709/230; 709/231; 709/232; 709/216

(58) Field of Classification Search ..... 455/3.01, 455/3.05, 3.06, 410–411, 414.1–414.4, 418, 455/11.1, 41.2, 41.3, 500, 502, 503, 556.1, 455/556.2, 557; 709/212, 216, 230–232, 709/237

See application file for complete search history.

(56) References Cited

U.S. PATENT DOCUMENTS

| | | | | |
|---|---|---|---|---|
| 7,000,002 | B2 * | 2/2006 | Suzuki et al. | 709/217 |
| 7,000,003 | B2 * | 2/2006 | Suzuki et al. | 709/217 |
| 7,000,004 | B2 * | 2/2006 | Suzuki et al. | 709/217 |
| 7,000,005 | B2 * | 2/2006 | Suzuki et al. | 709/217 |
| 7,054,914 | B2 * | 5/2006 | Suzuki et al. | 709/217 |
| 7,177,655 | B2 * | 2/2007 | Lai et al. | 455/466 |
| 7,231,454 | B2 * | 6/2007 | Togashi | 709/231 |

* cited by examiner

*Primary Examiner*—Tuan A Tran
(74) *Attorney, Agent, or Firm*—Thomas N. Twomey

(57) ABSTRACT

A system and a method for streaming data between a portable server computing device and a client computing device are provided. The method includes transmitting an RF signal having streaming data from a first audio file from the portable server computing device to a client computing device. The method further includes emitting sound corresponding to the streaming data in the RF signal from the client computing device, in response to the client computing device receiving the RF signal.

12 Claims, 3 Drawing Sheets

SYSTEM AND METHOD FOR STREAMING DATA BETWEEN A PORTABLE SERVER COMPUTING DEVICE AND A CLIENT COMPUTING DEVICE

BACKGROUND

MP3 devices have been utilized to store digital data and to play the digital data. In order to play the digital data for more than one person, the MP3 devices can be physically connected via a coupling wire to an external audio system. A drawback with this configuration is that a user must physically connect the MP3 device to the external audio system, via the coupling wire, during use. Further, if the user does not have the coupling wire, the MP3 device cannot be connected to the external audio system.

Accordingly, the inventors herein have recognized a need for an improved system for streaming digital audio data that minimizes and/or reduces the above-mentioned deficiencies.

SUMMARY OF THE INVENTION

A method for streaming data between a portable server computing device and a client computing device in accordance with an exemplary embodiment is provided. The method includes transmitting a first RF signal from the client computing device having a request message requesting a digital audio service. The method further includes transmitting a second RF signal from the portable sever computing device, in response to the portable server computing device receiving the first RF signal. The second RF signal has an acknowledgement message indicating that the portable server computing device is configured to provide the digital audio service. The method further includes transmitting a third RF signal from the portable server computing device having streaming data from a first audio file. The method further includes emitting sound corresponding to the streaming data in the third RF signal from the client computing device, in response to the client computing device receiving the third RF signal.

A system for streaming data in accordance with another exemplary embodiment is provided. The system includes a client computing device configured to transmit a first RF signal having a request message requesting a digital audio service. The system further includes a portable server computing device configured to transmit a second RF signal, in response to the portable server computing device receiving the first RF signal. The second RF signal has an acknowledgement message indicating that the portable sever computing device is configured to provide the digital audio service. The portable server computing device is further configured to transmit a third RF signal having streaming data from a first audio file. The client computing device is further configured to emit sound corresponding to the streaming data in the third RF signal, in response to the client computing device receiving the third RF signal.

DESCRIPTION OF EXEMPLARY EMBODIMENTS

Figure 1:
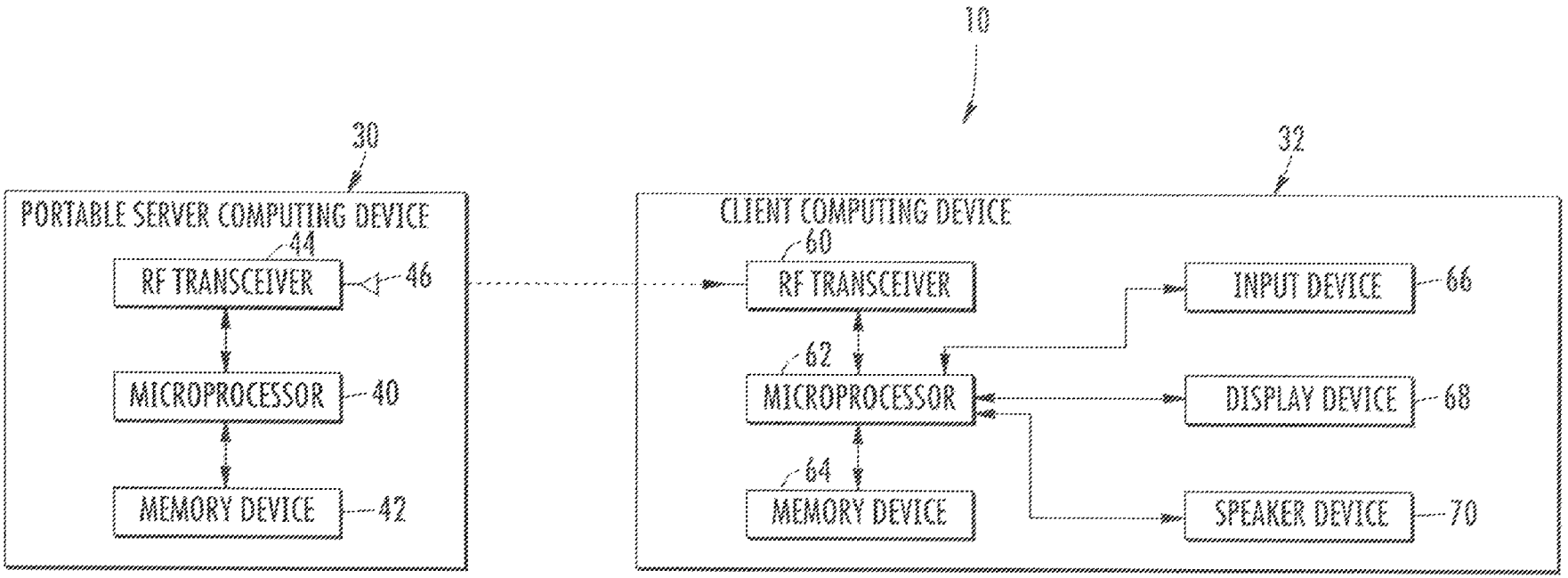
FIG. 1 is a block diagram of a system for streaming digital audio data having a portable server computing device and a client computing device in accordance with exemplary embodiment.

Referring to FIG. 1, a system 10 for streaming digital audio data in accordance with an exemplary embodiment is provided. The system 10 includes a portable server computing device 30 and a client computing device 32. An advantage of the system 10 is that the system utilizes RF signals to transmit digital audio data between devices.

The portable server computing device 30 provides a digital audio service to external devices such as the client computing device 32. The portable server computer device 30 includes a microprocessor 40, a memory device 42, an RF transceiver 44, and an antenna 46. The RF transceiver 44 is a configured to both transmit and receive RF signals. The RF signals can have one or more wireless protocols such as Wi-Fi, WiMax, and Bluetooth wireless protocols for example. In particular, the RF transceiver 44 is configured to receive RF signals having a request message requesting a digital audio service, from the client computing device 32. The microprocessor 40 is operably coupled to the RF transceiver 44 and is configured to receive the request message from the RF transceiver 44. The microprocessor 40 is further configured to induce the RF transceiver 44 to transmit RF signals having (i) an acknowledgment message indicating that the portable server computing device 30 is configured to provide the requested digital audio service, if applicable, and (ii) data associated with the plurality of audio files. It should be noted that the plurality of audio files area associated with the digital audio service. In one exemplary embodiment, the data associated with the plurality of audio files includes a plurality of audio file names associated with the plurality of audio files. The microprocessor 40 is further configured to induce the RF transceiver 44 to transmit RF signals having streaming data from one or more audio files stored on the memory device 42 which is operably coupled to the microprocessor 40. As illustrated, the antenna 46 is operably coupled to the RF transceiver 44. The antenna 46 is configured to transmit RF signals generated by the RF transceiver 44, and to receive RF signals from the client computing device 32.

The client computing device 32 is provided to request a digital audio service and to receive RF signals having streaming audio data corresponding to the digital audio service. The client computing device 32 includes an RF receiver 60, a microprocessor 62, a memory device 64, an input device 66, a display device 68, and a speaker device 70. The RF transceiver 60 is configured to both transmit and receive RF signals. The RF signals can have one or more wireless protocols such as Wi-Fi, WiMax, and Bluetooth wireless protocols for example. In particular, the RF transceiver 60 is configured to receive RF signals having both an acknowledgement message from the portable server computing device 30 indicating that the device 30 is configured to provide a requested digital audio service and data associated with a plurality of audio files stored on the portable server computing device 30. The microprocessor 62 is operably coupled to the RF transceiver 60 and is configured to receive the acknowledgement message from the RF transceiver 60 and the data associated with the plurality of audio files. The microprocessor 62 is further configured to induce the display device 68 to display at least a portion of the data associated with the plurality of audio files on the display device 68. In one exemplary embodiment, the data comprises a plurality of audio file names which are displayed on the display device 68. The microprocessor 62 is further configured to receive selection information from the input device 66 operably coupled to the microprocessor 62. In one exemplary embodiment, a user can select one or more audio file names that are displayed on the display device 68 utilizing the input device 66. The input device 66 can comprise any known input device utilized by those skilled in the art. For example, the input device 66 can comprise a keyboard or a computer mouse. The microprocessor 62 is further configured to induce the RF transceiver 60 to transmit RF signals having selected audio file names to the portable server computing device 30. Further, the RF receiver 60 is configured to receive RF signals from the portable server computing device 30 having streaming data from audio files stored on the portable server computing device 30. The microprocessor 62 is further configured to receive the streaming data from the RF receiver 60 and to induce the speaker device 70 to emit sound corresponding to the steaming audio data.

Figure 2:
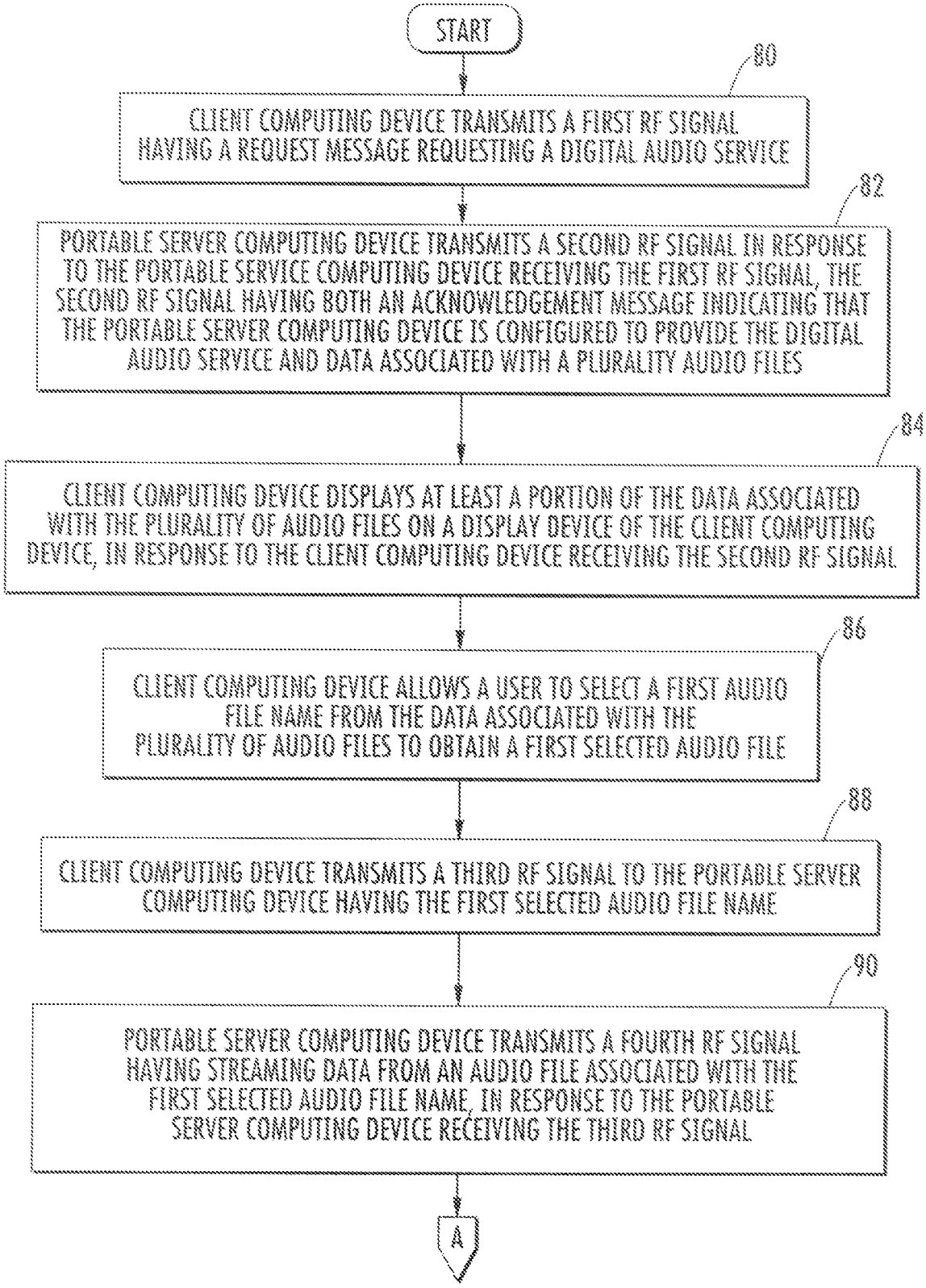
FIGS. 2-3 is a flowchart of a method for streaming digital audio data in accordance with another exemplary embodiment.
Figure 3:
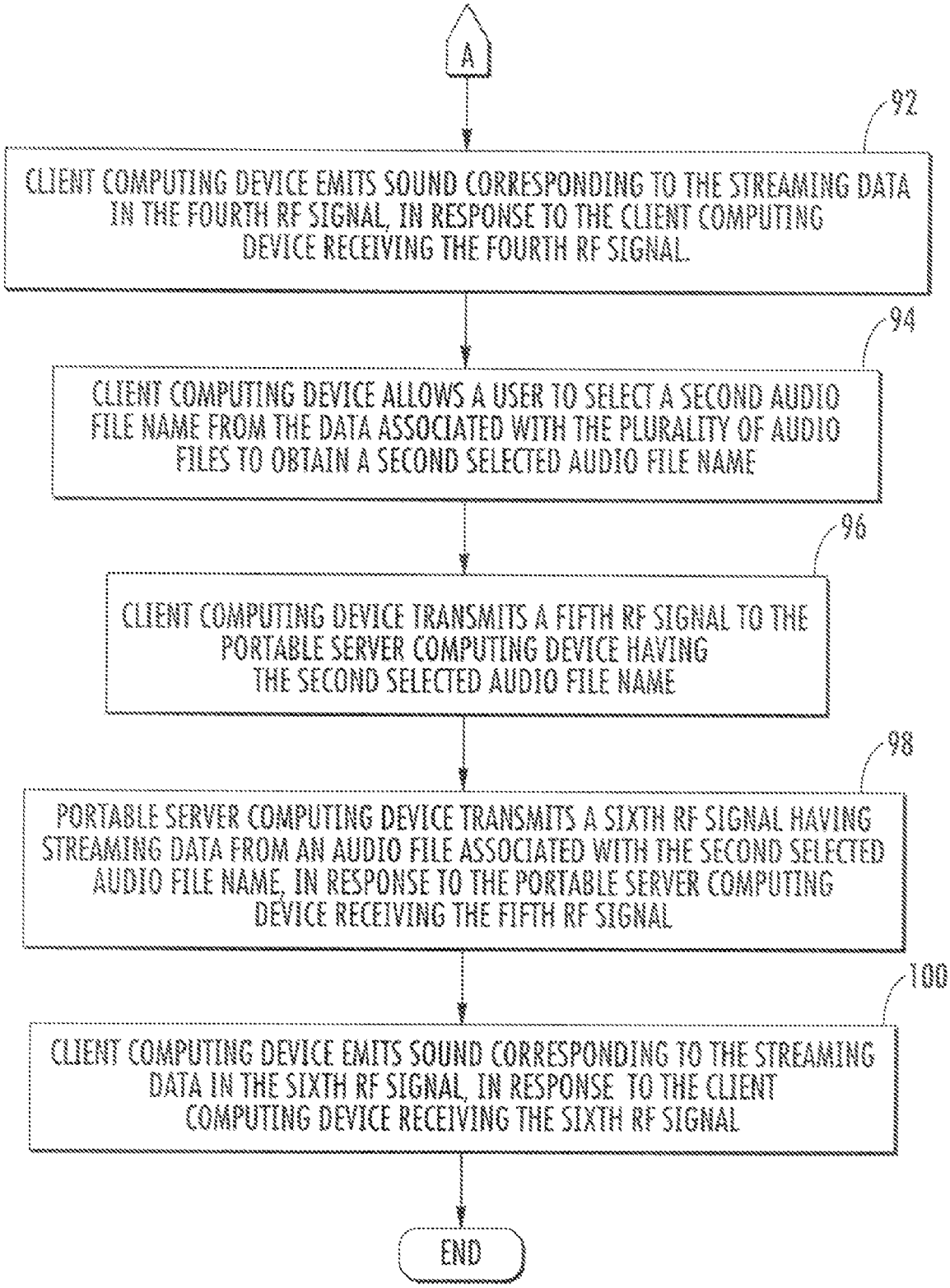

Referring to FIGS. 2-3, a flowchart of a method for streaming data between the portable server computing device 30 and the client computing device 32 will now be explained.

At step 80, the client computing device 32 transmits a first RF signal having a request message requesting a digital audio service.

At stop 82, the portable server computing device 30 transmits a second RF signal in response to the portable service computing device 30 receiving the first RF signal. The second RF signal has both an acknowledgement message indicting that the portable server computing device 30 is configured to provide the digital audio service and data associated with a plurality audio files.

At step 84, the client computing device 32 displays at least a portion of the data associated with the plurality of audio files on the display 68 of the client computing device 32, in response to the client computing device 32 receiving the second RF signal.

At step 86, the client computing device 32 allows a user to select a first audio file name from the data associated with the plurality of audio files to obtain a first selected audio file name. In particular, in one exemplary embodiment, the client computing device 32 allows a user to utilize the input device 66 to select the first audio file name.

At step 88, the client computing device 32 transmits a third RF signal to the portable server computing device 30 having the first selected audio file name.

At step 90, the portable server computing device 30 transmits a fourth RF signal having streaming data from an audio file associated with the first selected audio file name, in response to the portable server computing device 30 receiving the third RF signal.

At step 92, the client computing device 32 emits sound corresponding to the streaming data in the fourth RF signal, in response to the client computing device 32 receiving the fourth RF signal. In one exemplary embodiment, the client computing device 32 utilizes the speaker device 70 to emit sound corresponding to the streaming data in the fourth RF signal.

At step 94, the client computing device 32 allows a user to select a second audio file name from the data associated with the plurality of audio files to obtain a second selected audio file name.

At step 96, the client computing device 32 transmits a fifth RF signal to the portable sever computing device 30 having the second selected audio file name.

At step 98, the portable server computing device 30 transmits a sixth RF signal having streaming data from an audio file associated with the second selected audio file name, in response to the portable server computing device 30 receiving the fifth RF signal.

At step 100, the client computing device 32 emits sound corresponding to the streaming data in the sixth RF signal, in response to the client computing device 32 receiving the sixth RF signal. After step 100, the method is exited.

The system and method for streaming data between a portable server computing device and a client computing device represent a substantial improvement over other systems and methods. In particular, the system and method provide a technical effect of utilizing RF signals to stream audio data between the portable server computing device and the client computing device, which illuminates communication wires between the devises.

While the invention has been described with reference exemplary embodiments, it will be understood by those skilled in the art that various changes may be made and equivalent elements may be substituted for elements thereof without departing from the scope of the intention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the appended claims. Moreover, the use of the terms first, second, etc. do not denote any order or importance, but rather the terms first, second, etc. are used to distinguish one element from another. Further, the sue of the terms a, an, etc. do not denote a limitation of quantity, but rather denote the presence of at least one of the referenced item.

What is claimed is:

1. A method for streaming data between a portable server computing device and a client computing device, comprising:

transmitting a first RF signal from the client computing device having a request message requesting a digital audio service;

transmitting a second RF signal from the portable server computing device, in response to the portable server computing device receiving the first RF signal, the second RF signal having an acknowledgement message indicating that the portable server computing device is configured to provide the digital audio service;

transmitting a third RF signal from the portable server computing device having streaming data from a first audio file; and emitting sound corresponding to the streaming data in the third RF signal from the client computing device, in response to the client computing device receiving the third RF signal, wherein the second RF signal has both the acknowledgement message indicating that the portable server computing device is configured to provide the digital audio service and data associated with a plurality of audio files.

2. The method of claim 1, wherein the data associated with the plurality of audio files comprises textual data associated with the plurality of audio files.

3. The method of claim 2, wherein the textual data associated with the plurality of audio files comprises a plurality of audio file names.

4. The method of claim 1, further comprising displaying at least a portion of the data associated with the plurality of audio files on a display device of the client computing device, in response to the client computing device receiving the second RF signal.

5. The method of claim 4, further comprising:

selecting a first audio file name from the data associated with the plurality of audio flies to obtain a first selected audio file name associated with the first audio file, utilizing the client computing device;

transmitting a fourth RF signal from the client computing device to the portable server computing device having the first selected audio file name.

6. The method of claim 1, wherein the first RF signal utilizes one of a Wi-Fi wireless protocol, a Bluetooth wireless protocol, and a WiMax wireless protocol.

7. A system for streaming data, comprising:

a client computing device configured to transmit a first RF signal having a request message requesting a digital audio service;

a portable server computing device configured to transmit a second RF signal, in response to the portable server computing device receiving the first RF signal, the second RF signal having an acknowledgement message indicating that the portable sever computing device is configured to provide the digital audio service;

the portable server computing device further configured to transmit a third RF signal having streaming data from a first audio file; and the client computing device further configured to emit sound corresponding to the streaming data in the third RF signal, in response to the client computing device receiving the third RF signal, wherein the second RF signal has both the acknowledgement message indicating that the portable server computing device is configured to provide the digital audio service and data associated with a plurality of audio files.

8. The system of claim 7, wherein the data associated with the plurality of audio files comprises textual data associated with the plurality of audio files.

9. The system of claim 8, wherein the textual data associated with the plurality of audio files comprises a plurality of audio file names.

10. The system of claim 7 wherein the client computer device a further configured to display at least a portion of the data associated with the plurality of audio files on a display device, in response to the client computing device receiving the second RF signal.

11. The system of claim 10, wherein the client computing device is further configured to select a first audio file name from the data associated with the plurality of audio files to obtain a first selected audio file name associated with the first audio file, the client computing device further configured to transmit a fourth RF signal to the portable sever computing device having the first selected audio file name.

12. The system of claim 7, wherein the first RF signal utilizes one of a Wi-Fi wireless protocol, a Bluetooth wireless protocol, and a WiMax wireless protocol.

* * * * *